US008209803B2

(12) United States Patent
Bandel

(10) Patent No.: US 8,209,803 B2
(45) Date of Patent: Jul. 3, 2012

(54) PATIENT TRANSPORT SUPPORT

(76) Inventor: Brian Bandel, Lake Villa, IL (US)

( * ) Notice: Subject to any disclaimer, the term of this patent is extended or adjusted under 35 U.S.C. 154(b) by 707 days.

(21) Appl. No.: 12/313,345

(22) Filed: Nov. 19, 2008

(65) Prior Publication Data

US 2010/0122416 A1 May 20, 2010

(51) Int. Cl.
*A61G 1/04* (2006.01)

(52) U.S. Cl. ..... 5/626; 5/627; 5/625

(58) Field of Classification Search ..... 5/624–629
See application file for complete search history.

(56) References Cited

U.S. PATENT DOCUMENTS

| | | | | |
|---|---|---|---|---|
| 2,607,050 | A | 8/1952 | Binschoff | |
| 3,462,189 | A | 8/1969 | Kessling | |
| 4,369,982 | A | 1/1983 | Hein | |
| 5,179,746 | A * | 1/1993 | Rogers | 5/625 |
| 5,871,220 | A | 2/1999 | Lombard | |
| 6,357,063 | B1 | 3/2002 | Selby | |
| 6,845,533 | B1 | 1/2005 | Tulette | |
| 6,883,195 | B1 | 4/2005 | Gustavsen | |

* cited by examiner

*Primary Examiner* — Fredrick Conley
(74) *Attorney, Agent, or Firm* — Anne K. Burkhart

(57) ABSTRACT

A patient transport device includes a generally planar board having a width, length, and thickness defining a volume. At least one handle element is movably connected to the board. The at least one handle element is movable between a first, storage position in which the handle element is contained within the volume of the board, and a second, deployed position in which the handle element extends outwardly from the board. At least one foot support element is movably connected to the board, and is movable between a first, storage position in which the foot support element is contained within the volume of the board, and a second, deployed position in which the foot support element extends outwardly from the board. At least one roller element is rotatably secured to a bottom surface of the board. A patient to be transported is secured to the board and partially supported by the foot support and rolled via the at least one roller element by a single user of the board grasping the at least one handle element.

20 Claims, 6 Drawing Sheets

PATIENT TRANSPORT SUPPORT

CROSS-REFERENCE TO RELATED APPLICATION

None.

BACKGROUND OF THE INVENTION

The first recorded references to emergency medical treatment are associated with injuries sustained in battle, dating back to ancient Egyptian surgical texts from 3000 BC. The Greek physician Hippocrates (ca. 460-377 BC), for whom the doctor's Hippocratic Oath is named, advised his disciples, "He who would become a surgeon, let him join an army and follow it." In the 1st century AD, Plutarch wrote of ancient Spartan mothers giving their sons their first shields, and admonishing them to return from battle "with this or on it". This was perhaps the first reference to the use of devices for transporting casualties, as laminated Spartan shields were certainly large and strong enough to serve as battlefield stretchers.

The use of stretchers, and the heroism of stretcher bearers, is well documented in more recent times. While the stretchers themselves were canvas stretched on wooden frames rather than Spartan shields, the histories of the U.S. Civil War and WWI in particular are rife with accounts of the bravery and resolve of stretcher bearers.

Today, the need to transport patients with injuries is most often a civilian concern. Just as modern EMT personnel have available training and technology that would have been unimaginable a few generations ago, the simple stretcher has given way to spine boards and similar devices designed to be rigid, and lightweight while immobilizing the patient as required for transport.

Modern patient transport devices, in the form of stretchers and spine boards, have developed along with advances in materials and construction techniques, many of which are reflected in the patent literature. For example, U.S. Pat. No. 6,883,195 to Gustavsen is directed to a patient support apparatus having a back board receiving unit including a base portion having a back board receiving pocket formed therein and a footrest portion extending from the base portion; and a back board removably received in the back board receiving pocket. The back board support may include a locking apparatus to secure the backboard to the patient support.

U.S. Pat. No. 6,845,533 to Tulette shows a patient transport board comprising a flat, rigid board having a surface on which the patient lays and restraining straps for securing the patient. A pair of foldable rail members can be extended to serve as runners for moving the patient down a flight of stairs. A skid plate is provided at the foot end of the board to allow the board to be used in an upright mode for maneuvering in tight areas. In one embodiment wheel and axle assemblies are affixed at the lower end of the rail members to make easier movement of the patient transport board in an upright orientation. In another embodiment track assemblies allow for movement over rough or uneven surfaces when the patient transport board is in an upright orientation. Components of the patient transport board are foldable or removable so the board can be readily placed on a gurney or stored.

U.S. Pat. No. 6,357,063 to Selby deals with a wheeled dolly assembly for a patient carrier device having a box frame with a foldable footrest. Interchangeable wheels are mounted to an axle to facilitate rapid and easy movement of the dolly when a patient is strapped onto the patient carrier. The patient carrier device, such as a backboard, is retained in the box frame with adjustable pressure plates. Optional handles are mounted to the backboard through slots pre-formed in the backboard.

U.S. Pat. No. 5,871,220 to Lombard involves a dolly type apparatus, which would include a body portion having four wall portions, and defining a substantially rectangular opening therein, into which a typical spine board may be slid into the opening. The body portion further includes a pair of wheels, for allowing the body portion to be rolled onto a surface; there is further included a shelf member extending substantially out of the lower end of the body portion, onto which a patient placed on the spine board may rest his or her feet during transport; there is further provided strap members which extend from a first forward wall of the body portion through a pair of openings in the spine board and would reattach on the rear wall of the body portion for maintaining the spine board held in place in the opening in the body portion, so that a patient who is strapped to the spine board and whose feet are resting on the shelf member, may be raised substantially to the vertical position and the spine board may be rolled through tight passageways, during transport without affecting the stability or movement of the patient being transported.

U.S. Pat. No. 5,179,746 to Rogers discloses a stretcher operated by one or more persons for transporting an injured patient and including a body board for supporting a patient's upper legs and body, a slide member received within the body board and extendible selected distances therefrom, and a base portion connected to the slide member opposite the body board for supporting a patient's feet and ankles. The body board has a pair of protective skids which slide on a subjacent supporting surface with the skids supporting the body board and base portion a selected distance above the supporting surface. Wheels rotatably connected to the base portion support the stretcher when the stretcher is tilted relative to the supporting surface such that an individual may transport a patient on the stretcher. The wheels are supported above the skids and thus do not interfere with the sliding movement thereof. A pivotal foot rest is connected to the base portion and supports the patient when the stretcher is tilted about a transverse axis. Straps are provided to secure the patient to the stretcher and support the patient when the stretcher is tilted. An elongated handle assembly is pivotally connected to a selected end of the stretcher for controlling the sliding motion thereof down a steep incline. Flotation apparatus, detachably and reattachably connected to the body board, provide means for supporting the body board and a patient when the body board is placed in water. Apparatus for securing an oxygen tank to the stretcher is also provided and includes a transparent cover for isolating portions of the oxygen tank from the patient's body.

U.S. Pat. No. 4,369,982 to Hein includes a spine board having a detachably positionable foot support assembly to prevent the individual from sliding off of the spine board when it is raised to a substantially vertical position, or a wheel assembly which is removably affixed to the spine board so that the spine board can be easily transported by one person by wheeling it, or both.

U.S. Pat. No. 3,462,186 to Kessling is directed to a wheeled support for a patient in a body cast having a transverse rod connecting leg portions of the cast which includes a backing board, a transverse support mounted on the backing board for engaging and supporting the rod, wheels for supporting the backing board and means for supporting the backing board in an upright position with the wheels raised off the ground.

U.S. Pat. No. 2,607,050 to Binschoff shows a device adapted for the removal of an inert invalid from the bed in order that the patient may be placed in an erect or semi-erect position to alleviate the possibility of bed pneumonia or circulatory complications due to inactivity. The patient is strapped to the device so that the patient will be supported at several locations and will be held erect as the device is turned on end so that the patient's weight can be taken by the foot board which is hinged upwardly and supported. Wheels may be applied to the device to permit the transport of the patient outdoors for sunlight or other distant points from the bed.

Although the arrangements described in these patents provide certain advantages, they present certain deficiencies as well. For example, known patient transport devices are often difficult to maneuver around corners in narrow interior passageways. Further, many of these devices require at least two persons to lift and carry a patient. It can thus be seen that the need exists for a simple, efficient, and easily manufactured patient transport support.

SUMMARY OF THE INVENTION

A patient transport device includes a generally planar board having a width, length, and thickness defining a volume. At least one handle element can be movably connected to the board. The at least one handle element is movable between a first, storage position in which the handle element is contained within the volume of the board, and a second, deployed position in which the handle element extends outwardly from the board. At least one foot support element is movably connected to the board, and is movable between a first, storage position in which the foot support element is contained within the volume of the board, and a second, deployed position in which the foot support element extends outwardly from the board. At least one roller element is rotatably secured to a bottom surface of the board. A patient to be transported is secured to the board and partially supported by the foot support and rolled via the at least one roller element by a single user of the board grasping the at least one handle element.

BRIEF DESCRIPTION OF THE DRAWINGS

Embodiments of the invention are illustrated by way of example, and not by way of limitation, in the figures of the accompanying drawings and in which like reference numerals refer to similar elements and in which.

DETAILED DESCRIPTION OF THE INVENTION

Figure 1:
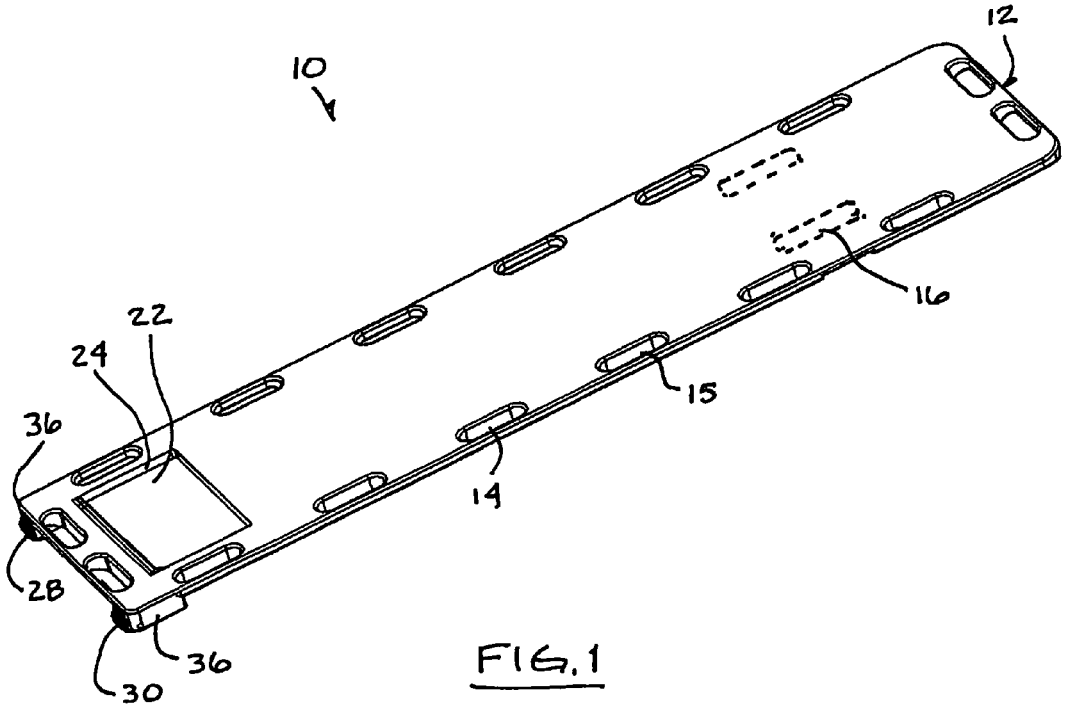
FIG. 1 illustrates a perspective view of an embodiment of a patient transport device in accordance with the principles of the present invention.

In the following description, specific details are set forth in order to provide a thorough understanding of the invention. However, it will be apparent that the invention may be practiced without these specific details. Without departing from the generality of the invention disclosed herein and without limiting the scope of the invention, the discussion that follows, will refer to the invention as depicted in the drawings.

Figure 2:
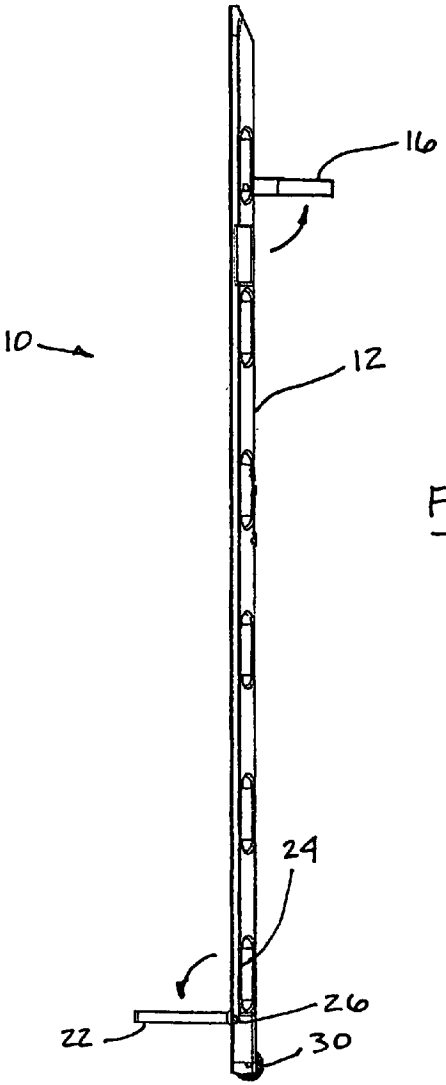
FIG. 2 illustrates a schematic side view of the FIG. 1 embodiment.

The first embodiment of a patient transport device 10 in accordance with the principles of the present invention is shown in FIGS. 1 and 2. The patient transport device 10 includes generally planar, rigid spine board 12 having a width, length, and thickness defining a volume. The spine board 12 is of conventional construction, and includes a plurality of handholds 14 to facilitate grasping of the spine board 12 by users, such as EMT personnel, during patient transport. The handholds 14 also accommodate clip pins 15, which can be used to secure straps and the like. As is known in the art, the spine board 12 and clip pins 15 can be fabricated to be transparent to medical imaging devices, for example, x-ray and CT-scan devices.

Figure 3:
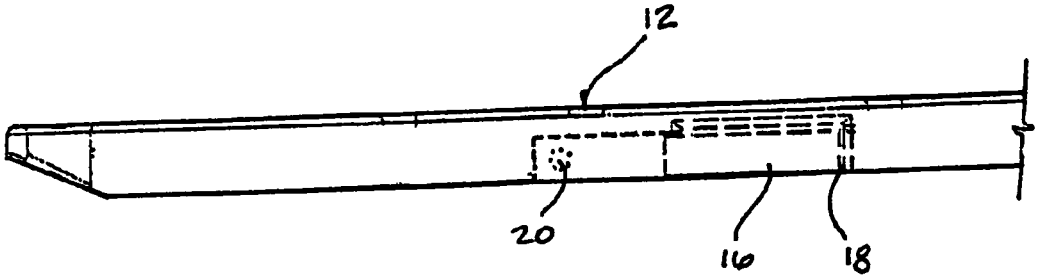
FIG. 3 illustrates a detailed sectional view of a handle assembly in a storage position.
Figure 4:
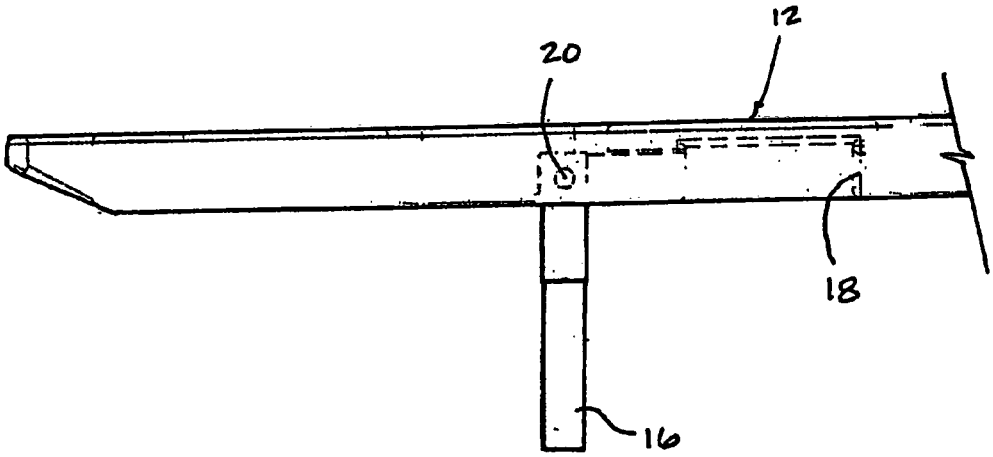
FIG. 4 illustrates a detailed sectional view of a handle assembly in a deployed position.

At least one handle element 16 is movably connected to the board 12. As shown in FIGS. 3 and 4, the handle element 16 is movable between a first, storage position (FIG. 3) in which the handle element 16 is contained within the volume of the board 12, and a second, deployed position (FIG. 4) in which the handle element 16 extends outwardly from the board 12. In the illustrated example, a pair of handle elements 16 are provided, and are secured in recesses 18 (shown in FIGS. 3 and 4) in the board 12. The handle elements 16 are pivotably secured within the recesses 18 by means of pivot pins 20. The pivot pins 20 are similar in material and configuration to standard clip pins 15. The handle elements 16 are configured to have a friction fit lock to hold them in their storage position and a stop to hold them in their deployed position, and are fabricated to be transparent to medical imaging devices, for example, x-ray and CT-scan devices.

At least one foot support element 22 is movably connected to the board 12, and is movable between a first, storage position (FIG. 1) in which the foot support element 22 is contained within the volume of the board 12, and a second, deployed position (FIG. 2) in which the foot support element 22 extends outwardly from the board. In the illustrated embodiment, the foot support element 22 is secured in a recess 24 in the board 12. The foot support element 22 is pivotably secured within the recess 24 by means of a pivot pin 26. The pivot pin 26 is similar in material and configuration to standard clip pins 15. In the illustrated embodiment, the foot support element 22 is configured to have a friction fit lock to hold it in it's storage position and a stop to hold it in it's deployed position, and is fabricated to be transparent to medical imaging devices, for example, x-ray and CT-scan devices.

Figure 5:
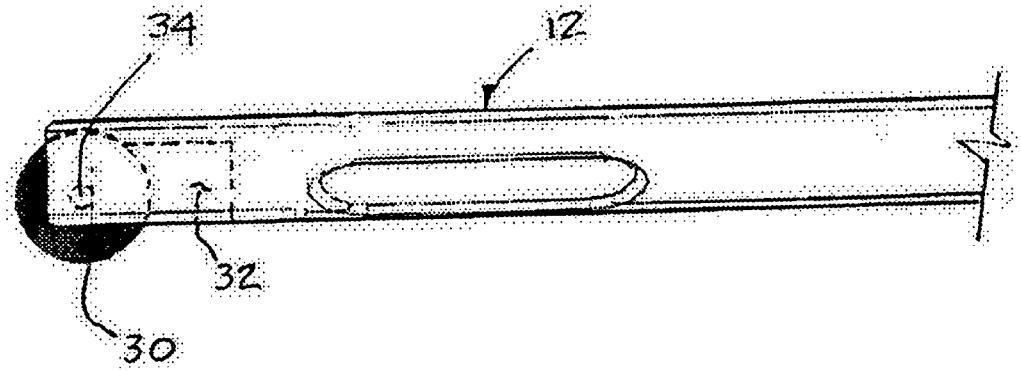
FIG. 5 illustrates a detailed sectional view of a roller assembly.

At least one roller element, here shown as a pair of roller elements 28, 30, is rotatably secured to a bottom surface of the board 12. As shown in FIG. 5, the roller elements 28, 30, of which 30 is shown, are secured within recesses 32 in the bottom of the board 12 via axles 34, which are similar in material and configuration to standard clip pins 15. The geometry of bottom corners 36 of the board 12 is selected to accommodate the necessary wheel base to enable safely moving a patient via the roller elements 28, 30. Any suitable geometry for the corners 36 can be selected, such as the rectangular geometry of the corners 36 illustrated in FIG. 1. The roller elements are recessed so that they are in contact with the floor or ground when the transport device 10 is tilted upwardly for use, but do not interfere with sliding the transport device 10 in and out of vehicles or onto gurneys when the transport device 10 is horizontal. The roller elements 28, 30 are fabricated from a rigid and durable material, such as a thermoplastic.

In use, a patient to be transported is secured to the board 12 by straps, and partially supported by the foot support element 22 in its deployed position. The handle elements 16 are pivoted to their deployed position, and the board 12 and patient are tilted to permit rolling contact of the roller elements 28, 30 with the floor or ground. A single user can then roll the patient on the board 12, and change the angle of inclination of the board 12 and patient to maneuver through difficult areas, such as narrow interior hallways, sharp corners, and the like. Transportation of immobilized patients is difficult or impossible using known transport devices in such areas, particularly if only one EMT is available.

Figure 6A:
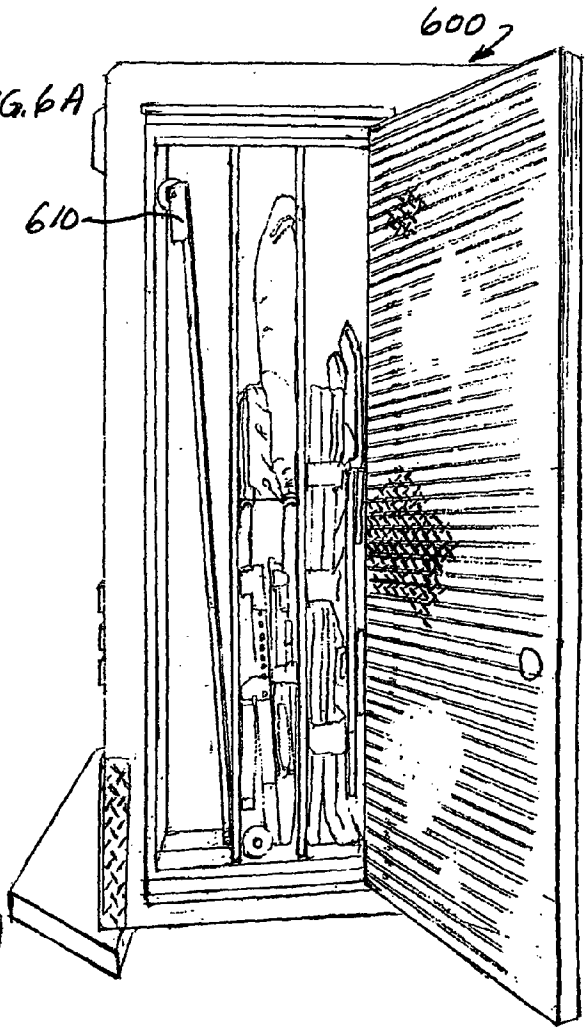
FIGS. 6 and 6*a* illustrate perspective views of an ambulance for storing an embodiment of a patient transport device constructed in accordance with the principles herein.
Figure 6:
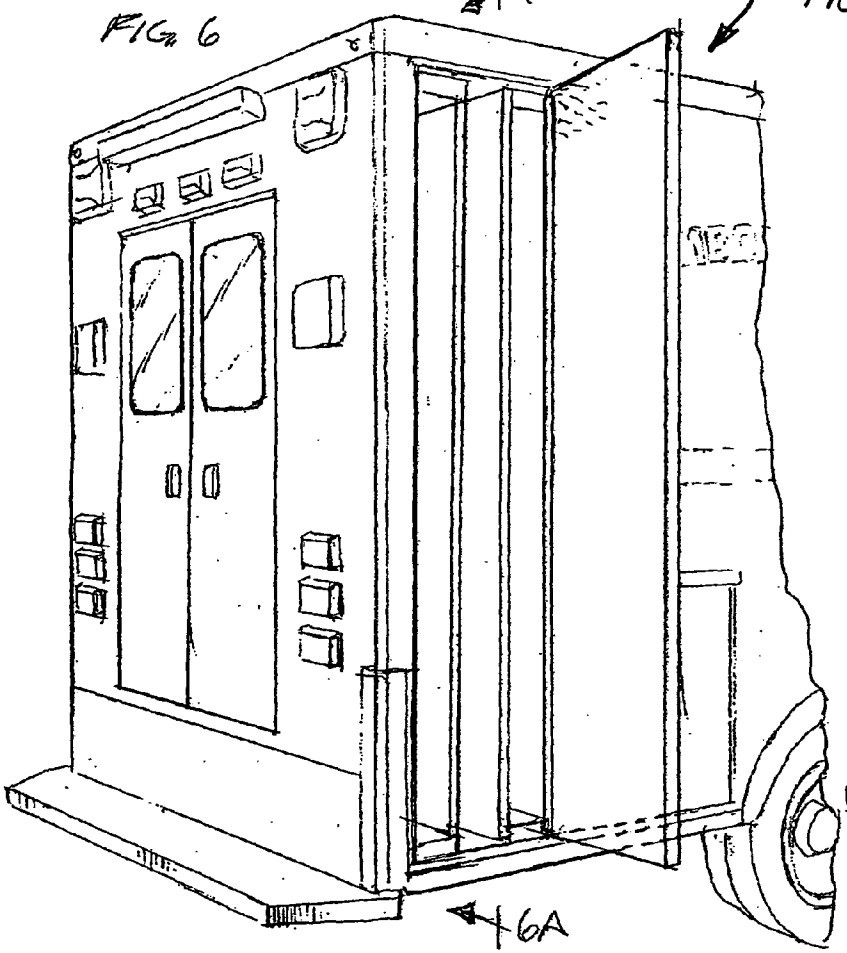

Further, the known boards fail to provide a combination of elements that allow emergency personnel to both competently direct and operate movement of a spine board when occupied by a patient, as well as store the spine board within a standard space provided for spine boards on a conventional ambulance without first having to remove accessories from the board, as illustrated, for example in FIGS. 6 and 6A, wherein a board 610 is stored in an ambulance shown generally at 600.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention resides not in any one of these features per se, but rather in the particular combinations of some or all of them herein disclosed and claimed and it is distinguished from the prior art in these particular combinations of some or all of its structures for the functions specified.

With respect to the above description then, it is to be realized that the optimum dimensional relationships for the parts of the invention, including variations in size, materials, shape, form, function and manner of operation, assembly and use, and all equivalent relationships to those illustrated in the drawings and described in the specification, that would be deemed readily apparent and obvious to one skilled in the art, are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim as my invention:

1. A patient transport device comprising the following:

a generally planar non-extendable board, transparent to medical imaging devices, having a width, length, and thickness defining a volume;

at least one handle element movably connected to the board, the handle element being movable between a first, storage position in which the handle element is contained within the volume of the board, and a second, deployed position in which the handle element extends outwardly from the board;

at least one foot support element movably connected to the board, the foot support element being movable between a first, storage position in which the foot support element is contained within the volume of the board, and a second, deployed position in which the foot support element extends outwardly from the board; and at least one roller element rotatably secured to a bottom surface of the board;

whereby a patient to be transported is secured to the board and partially supported by the foot support and rolled via the at least one roller element by a single user of the board grasping the at least one handle element, and wherein the device is configured to store within a space provided for the device on an ambulance without first having to remove accessories from the device.

2. A patient transport device in accordance with claim 1, wherein the board is further defined by a spine board.

3. A patient transport device in accordance with claim 1, wherein the at least one handle element comprises a pair of handle elements.

4. A patient transport device in accordance with claim 3, wherein the handle elements pivot between the storage position and the deployed position.

5. A patient transport device in accordance with claim 4, further comprising a pair of handle pivot pins pivotably securing the handles to the board.

6. A patient transport device in accordance with claim 5, wherein the handle pivot pins are transparent to medical imaging devices.

7. A patient transport device in accordance with claim 1, wherein the foot support element pivots between the storage position and the deployed position.

8. A patient transport device in accordance with claim 7, further comprising a foot support pin pivotably securing the foot support to the board.

9. A patient transport device in accordance with claim 8, wherein the foot support pivot pin is transparent to medical imaging devices.

10. A patient transport device comprising the following:

a generally planar non-extendable spine board having a width, length, and thickness defining a volume;

at least one foot support element movably connected to the spine board within the volume of the spine board, the foot support element being movable between a first, storage position in which the foot support element is contained within the volume of the spine board, and a second, deployed position in which the foot support element rotates outwardly from the spine board; and at least one roller element rotatably secured to a bottom surface of the spine board;

whereby a patient to be transported is secured to the spine board and partially supported by the foot support and rolled via the at least one roller element by a single user of the spine board grasping the at least one handle element.

11. A patient transport device as claimed in claim 10, further comprising:

at least one handle element movably connected to the spine board, the handle element being movable between a first, storage position in which the handle element is contained within the volume of the spine board, and a second, deployed position in which the handle element extends outwardly from the spine board.

12. A patient transport device as claimed in claim 10, further comprising:

at least one handhold having a suitable geometry provided near an edge of the spine board.

13. A patient transport device as claimed in claim 12, wherein the handhold has an oval configuration.

14. A patient transport device as claimed in claim 10, wherein the handhold is formed by providing an aperture in the spine board.

15. A patient transport device comprising:

a board for transporting an immobilized patient having a non-extendable top, a non-extendable bottom, and a continuous edge between the top and the bottom;

the entirety of the board formed of a transparent material; and a foot support element rotatably connected to the board between the top and the bottom of the board, the foot support element rotating from a closed position, within the volume of the board, to an open position extending outwardly and beyond the continuous edge of the board.

16. A patient transport device as claimed in claim 15, further comprising:

at least one handle element movably connected to the board, the handle element being movable between a first, storage position in which the handle element is contained within the volume of the board, and a second, deployed position in which the handle element extends outwardly from the board.

17. A patient transport device as claimed in claim 15, further comprising:

at least one handhold, having a suitable geometry, provided near an edge of the board.

18. A patient transport device as claimed in claim 17, wherein the handhold has an oval configuration.

19. A patient transport device as claimed in claim 17, wherein the handhold is formed by providing an aperture in the board.

20. A patient transport device as claimed in claim 15, further comprising at least one roller element, the roller element secured in a recess of the board via an axle.

* * * * *